US005140334A

United States Patent [19]

Snyder et al.

[11] Patent Number: 5,140,334

[45] Date of Patent: Aug. 18, 1992

[54] COMPACT OMNIDIRECTIONAL ANTENNA

[75] Inventors: Keith A. Snyder, Dublin; Gary L. Peisley, Santa Clara, both of Calif.

[73] Assignee: GTE Government Systems Corp., Mountain View, Calif.

[21] Appl. No.: 638,276

[22] Filed: Jan. 7, 1991

[51] Int. Cl.[5] ..... H01Q 13/00

[52] U.S. Cl. ..... 343/773; 343/846

[58] Field of Search ..... 343/773, 774, 775, 825, 343/826, 829, 830, 846, 848, 807, 808, 912

[56] References Cited

U.S. PATENT DOCUMENTS

| | | | |
|---|---|---|---|
| 2,786,998 | 3/1957 | Davis | 343/775 |
| 3,169,311 | 2/1965 | Small et al. | 343/912 |
| 3,536,800 | 10/1970 | Hubbard | 343/912 |
| 4,647,329 | 3/1987 | Oono et al. | 343/912 |
| 4,851,859 | 7/1989 | Rappaport | 343/773 |

FOREIGN PATENT DOCUMENTS

| | | | |
|---|---|---|---|
| 114368 | 12/1940 | Australia | 343/773 |
| 0197803 | 3/1978 | Fed. Rep. of Germany | 343/773 |

*Primary Examiner*—Michael C. Wimer
*Assistant Examiner*—Tan Ho
*Attorney, Agent, or Firm*—John F. Lawlor; James J. Cannon, Jr.

[57] ABSTRACT

A broadband omnidirectional antenna comprises a figure of revolution having an axis and two axially spaced coaxial elements with rolled radially outer edge portions and defining therebetween an antenna aperture. One element has a conically-shaped aperture-defining surface radially diverging from a plane aperture-defining surface on the other element extending perpendicular to the axis, the outer edge portions of both surfaces being curved away from each other and back toward the axis. This antenna operates over a 500 MHz to 7 GHz band with a VSWR of approximately 3:1. The invention also comprehends a method of forming the antenna elements in metallically coated molds with a fiberglass-resin mix.

1 Claim, 5 Drawing Sheets

COMPACT OMNIDIRECTIONAL ANTENNA

BACKGROUND OF THE INVENTION

This invention was made with Government support under Contract No TEDD 8005 awarded by the Department of the Air Force. The Government has certain rights in this invention.

This invention relates to antennas and more particularly to a compact omnidirectional antenna.

The discone antenna is well known as a relatively broadband antenna. A high performance antenna of this type typically has an operating frequency of 0.5 to 8 GHz with a VSWR of about 3.5:1 over nearly 90% of the band. A problem that is experienced with such prior art antennas is their relatively large size required to operate at low frequencies. In applications where available space is extremely limited, such a disadvantage may well disqualify utilization of this antenna. This invention provides a compact discone-type antenna having substantially improved performance over a broad bandwidth.

OBJECTS AND SUMMARY OF THE INVENTION

A general object of the invention is the provision of a discone-type omnidirectional antenna having improved performance over a broad operating frequency band.

A further object is the provision of such an antenna that is lightweight, rugged and extremely compact.

A more specific object is the provision of an omnidirectional antenna having a VSWR of 3.5:1 or less over an operating band of 0.5 GHz–8 GHz and more.

Another object is the provision of such an antenna having principal radiating elements formed of the same lightweight material so as to minimize adverse effects of operating in an environment having widely varying temperatures.

Another object is the provision of a method of making such an antenna that is simple to perform and produces a lightweight rugged antenna.

These and other objects are achieved with a discone antenna having center-fed cone and disc elements with radially outer edge portions rolled backwardly and away from each other to form donut-shaped configurations. The rolled edges not only reduce the diameter of the antenna but also permit currents to travel around them smoothly and without reflections that degrade the VSWR at the low end of the frequency band. The invention also comprehends a method of making antenna elements of a lightweight dielectric material having aperture-defining surfaces coated with a metallic film.

DESCRIPTION OF PREFERRED EMBODIMENT OF THE INVENTION

Figure 1:
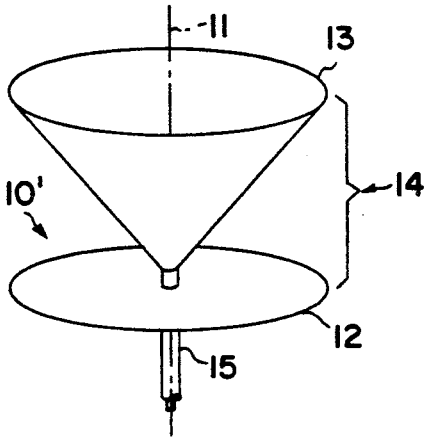
FIG.1 PRIOR ART
FIG. 1 is a perspective view of a prior art discone antenna.
Figure 2:
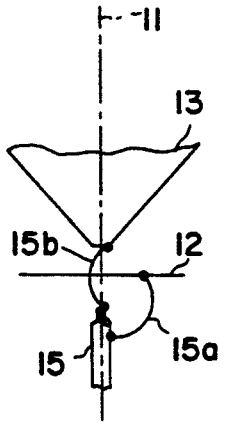
FIG.2 PRIOR ART
FIG. 2 is an enlarged schematic partial view of the antenna of FIG. 1 showing the feed line connections.

Referring now to the drawings, a prior art discone antenna 10 having an axis 11 is shown in FIGS. 1 and 2 and comprises a plane conductive disc element 12 spaced close to and axially aligned with conductive cone element 13 and defining an aperture 14 therebetween. Elements 12 and 13 are center fed, for example by a coaxial line 15 as shown with outer conductor **15*a* connected to disc element 12 and inner conductor 15*b* connected to cone element 13. Antenna aperture 14 is an annular space between radially outwardly diverging elements 12 and 13 and when energized by feed line 15 radiates (or receives) electromagnetic waves generally omnidirectionally and normal to axis 11**. Typically such an antenna has an outside diameter of 19" and height of 9" operates over a frequency range of 0.5 to 8 GHz with a VSWR of approximately 3.5:1 over 90% of the operating band.

Figure 3:
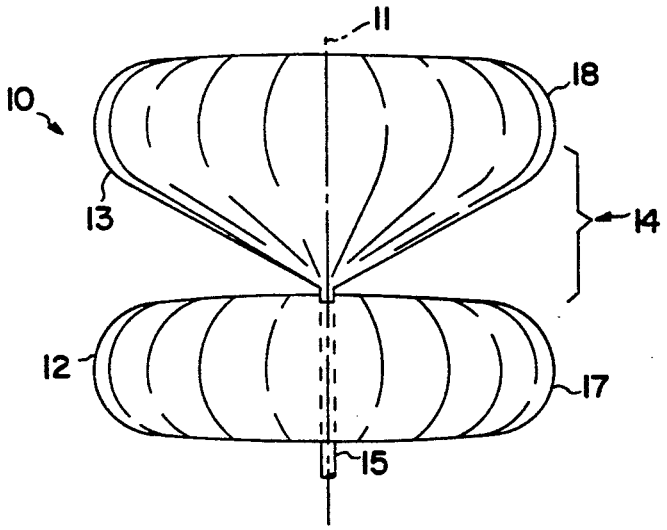
FIG. 3 is a simplified elevation of a discone antenna embodying this invention.
Figure 4:
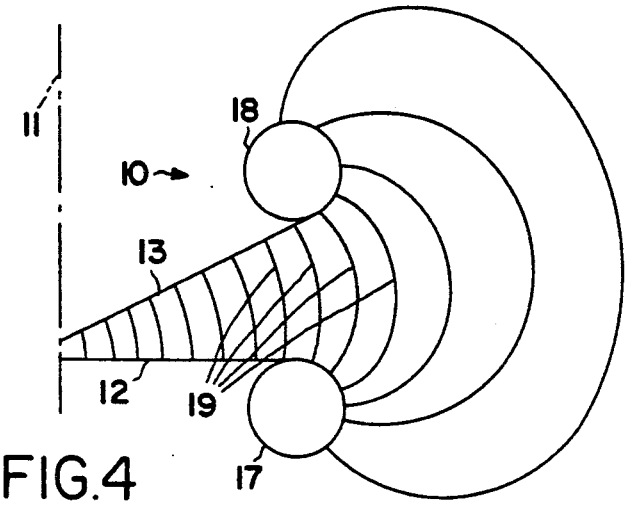
FIG. 4 is a schematic view of part of the antenna of FIG. 3 showing the electric field distribution.

In accordance with this invention, the size of such an antenna is substantially reduced without degradation of performance with an antenna 10', see FIGS. 3 and 4, having compound curved or rounded radially outer edge portions 17 and 18 on disc element 12' and cone element 13', respectively, like parts of the antennas being indicated on the drawings by the primes of like reference characters. Antenna 10' is a figure of revolution about axis 11' and accordingly outer edge portions 17 and 18 have a donut-like shapes and curve away and backwardly from aperture 14'. As shown more clearly in FIG. 4, outer edge portions 17 and 18 have circular cross-sectional shapes.

The effectively reduced size of antenna 10' without degradation of its performance as discussed in detail hereinafter, is attributable to the rolled outer edge portions 17 and 18 which enable the electric field, illustrated schematically at 19 in FIG. 4, to travel around edge portions 17 and 18 smoothly and without reflections that would tend to degrade the VSWR at the low end of the frequency band. Aperture 14 functions as a physically larger one due to the increased surface area of the rounded edge portions 17 and 18 without a corresponding increase in actual diameter.

Figure 5:
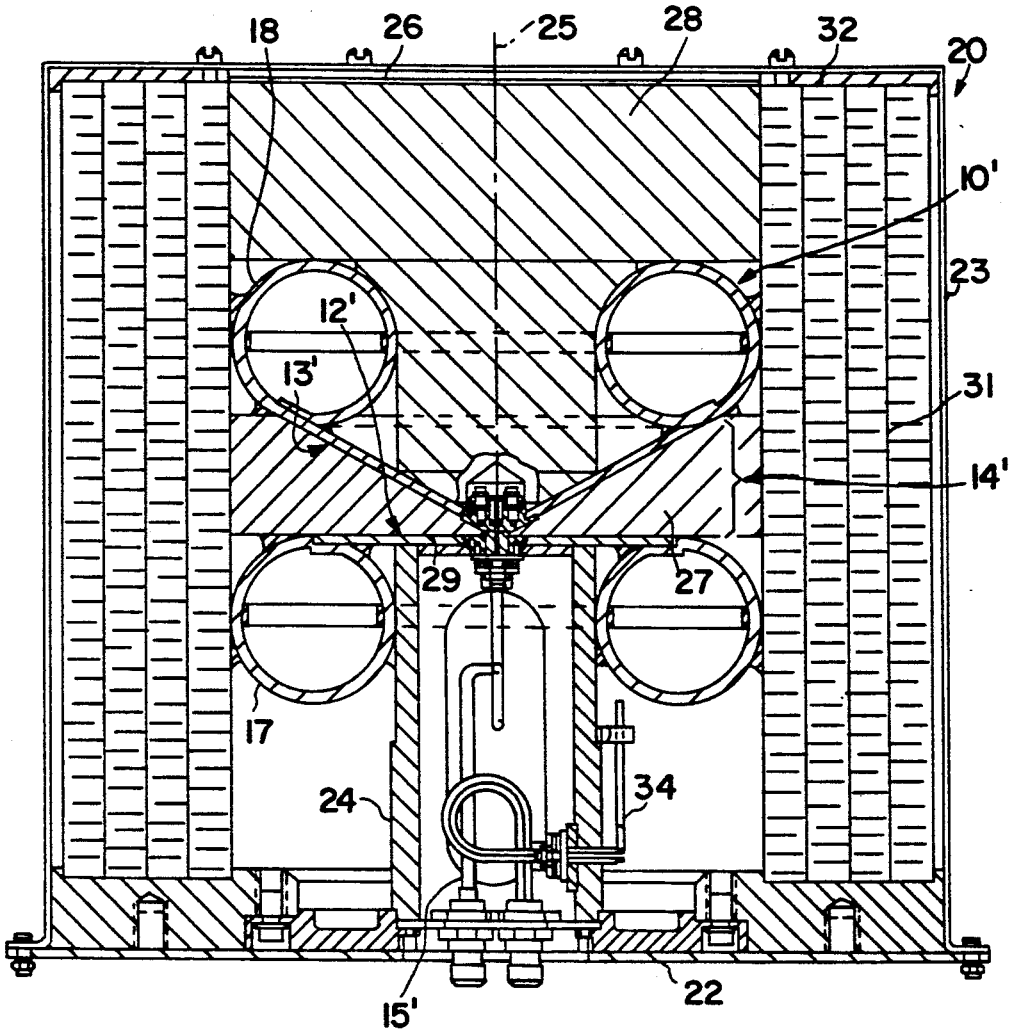
FIG. 5 is a vertical center section of an antenna assembly embodying this invention and including a polarizer.

Referring to FIG. 5, a complete antenna assembly 20 prepared for installation in the field, such as in a radome of an aircraft, comprises a base plate 22 for mounting the unit on a rigid platform, not shown, an inverted cup-shaped cylindrical shipping container 23 (removed prior to installation) secured to plate 22, and antenna 10' supported on a hollow dielectric post 24 which is secured to base plate 22. Post 24 has a vertical axis 25. Coaxial feed line 15' extends through post 24 for connection to antenna 10' along axis 25. Antenna aperture 14' contains a radiation previous filler 27, such as polyurethane foam, to prevent moisture condensation and also to provide support for antenna elements 12' and 13'. The central part of disc element 12' is supported directly on the top of post 24. Additional fill material 28 similar to filler 27 is disposed between cone element 13' and a top plate 26 serves the same purpose as filler 27. Coaxial feed line 15' extends through base plate 22 for connection to elements 12' and 13' along axis 25.

When antenna assembly 20 is mounted for operation with axis 25 extending vertically as shown and is energized, electromagnetic waves propagating through aperture 14' are vertically polarized. In order to maximize the sensitivity of the antenna used in the acquisition or receive mode to signals polarized in directions between vertical and horizontal, a multilayer polarizer 31 is mounted coaxially around the exterior of antenna 10' between an upper plate 32 and base plate 22 adjacent to the mouth of aperture 14'. Polarizer 31 comprises a plurality of coaxial layers, for example, four as shown, each layer consisting of wire grids approximately 0.01" wide and printed on layers of Teflon with 0.4" spacing between each grid. Optimum spacing between layers is 0.5". Wire grids in the innermost layer (adjacent to antenna 10') are horizontal relative to vertical axis 25 and wire grids in the outermost layer are at a 45 degree angle with respect to those in the innermost layer.

Polarizer 31 rotates vertically polarized electric fields proximate to the outer edge portions of aperture 14' to slant 45 degrees at the outermost layer of polarizer 31 (transmit sense). Intermediate polarizer layers have wire grid angles that induce rotation of the angle of polarization of the transmitted waves from inner to outer polarizer layers from horizontal to 45 degrees. The slant 45 degree polarizer 31 enables the antenna to be sensitive to and to pick up either vertically or horizontally polarized signals in the receive mode.

A bit probe 34 connected to the exterior of assembly 20 provides a means of introducing a test signal into the antenna for test purposes.

Figure 6:
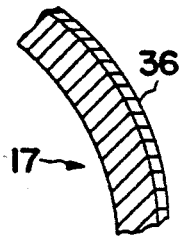
FIG. 6 is a greatly enlarged view of part of one of the antenna rolled outer edge portions shown in FIG. 5.
Figure 7:
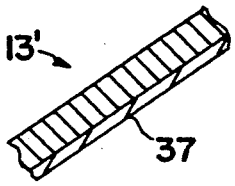
FIG. 7 is a greatly enlarged view of part of the conical antenna portion shown in FIG. 5.

Disc and cone rolled outer edge portions 17 and 18 are covered with a metallic film as shown at 36 for edge portion 17 in FIG. 6. The opposing surfaces of disc element 12' and cone element 13' that define aperture 14 likewise comprise metallic films as shown at 37 for cone element 13 in FIG. 7. These metallic films are formed, for example, by flame spraying a conductor such as tin or zinc into the molds for the antenna components as described below.

Figure 8:
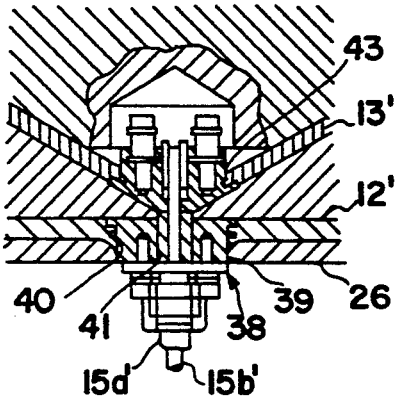
FIG. 8 is a greatly enlarged view of the antenna feed line connections shown in FIG. 5.

The connection of coaxial feed line 15' to antenna elements 12' and 13' is effected by means of a connector 38 as shown in detail in FIG. 8. Connector 38 comprises an externally threaded metal bushing 39 to which outer conductor 15a' of cable 15' is connected. Bushing 39 engages a tapped hole 40 in post plate 26 and makes electrical contact with the metallic film on the upper (as viewed in FIG. 8) side of disc element 12'. Inner conductor 15b' extends through an insulator tube 41 in bushing 39 for connection to clamp 43 on the top side, as viewed, of cone element 13'. Clamp 43 makes electrical contact with the metallic film 37 on the inner face of element 13'. Connector 38 insures good electrical contact between feed cable 15' and antenna elements 12' and 13' even in a severe operational environment of high vibration and shaking.

Figure 9:
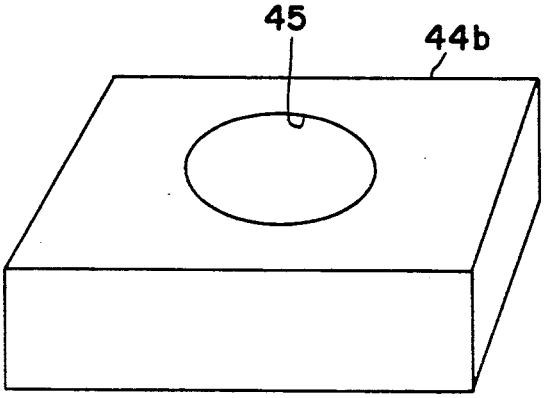
FIG. 9 is a perspective view of part of a mold used in forming the rolled outer edge portions of the antenna.
Figure 10:
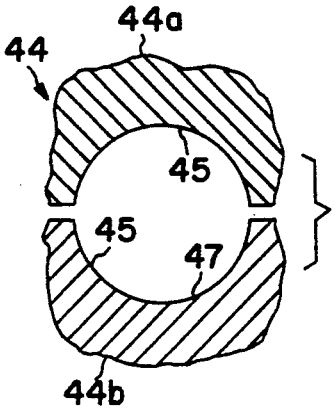
FIG. 10 is an enlarged transverse section of parts of the two halves of the mold used in forming the rolled edge portions of the antenna.
Figure 11:
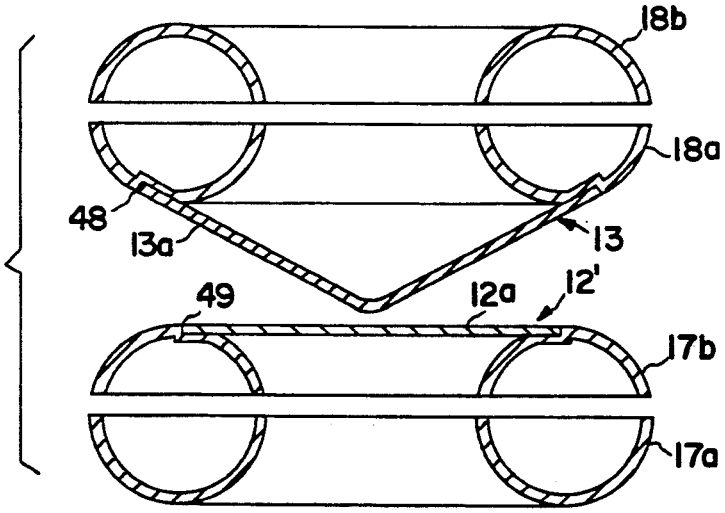
FIG. 11 is an exploded central vertical section of the cone and disc antenna elements embodying the invention illustrating the method of antenna construction.

The rolled edge and cone portions of element 13' are formed by the following process. A mold 44, see FIGS. 9 and 10, having an upper (as viewed) half 44a and a lower half 44b, is provided for forming the two halves 18a and 18b, respectively, of the curved or toroidally-shaped outer edge portions of cone element 13. Each half of mold 44 has a semi-spherically-shaped cavity 45 having the shape of one-half of each of the rolled antenna outer edge portions 17 and 18. The interior of cavity 45 is first coated with a release agent, such as PVA parting film, and a molten conductor is flame sprayed into the cavity, forming a metallic film therein. Dielectric material such as a fiberglass laminate mixed with a resin is then hand laid into cavity 45 to form a shell 18a constituting one-half of the rolled edge portion. The laminate is then cured in an oven up to a temperature of 150° for about 60 minutes, is cooled, and shell 18a is then removed from the mold. The other shell 18b is similarly formed in mold 44a. The two shells 18a and 18b comprising halves of each of part 18 as shown in FIG. 11, are next mated at their edges and are bonded together, the joint between the two parts being filled with a conductive epoxy such as silver epoxy to secure the parts together and to form a donut-shaped structure with a continuous metallic outer surface. Shells 17a and 17b are similarly formed in a mold and secured together.

In one embodiment of the invention, the wall thickness of shells 17a, 17b, 18a and 18b is 0.040" being made of four 0.010" plies of fiberglass. Optionally, in order to strengthen the seam between the half-shells 18a and 18b, a band comprising few layers of a fiberglass and epoxy is laid on the inside of the shells 17a, 17b, 18a and 18b over the respective joined edges.

In order to join the planar parts with the curved parts of the antenna, such as fitting cone part 13a of element 13 into curved portion 18a as shown in FIG. 11, cavity 45 of mold part 44b has shoulder 47 protruding into the cavity which forms a recess 48 in the exterior of shell 18a. The mold, not shown, for forming shell 17b likewise has a similar shoulder that makes a recess 49 in the shell to receive the outer edge of the disc part 12a of element 12'. The planar and curved part are secured together by the aforementioned conductive epoxy.

Disc part 12a and cone part 13a of elements 12 and 13 are also similarly formed in molds with corresponding shaped cavities and using the same materials and following the same steps recited above, Rolled edge portions 17 and 18 are then mated with the cone and disc portions, as shown in FIG. 11, with conductive epoxy in the joints to secure the parts together and to maintain continuity of the conductive film on the exterior surfaces of the antenna. All joints are smooth, thus avoiding any rf reflections.

Figure 12:
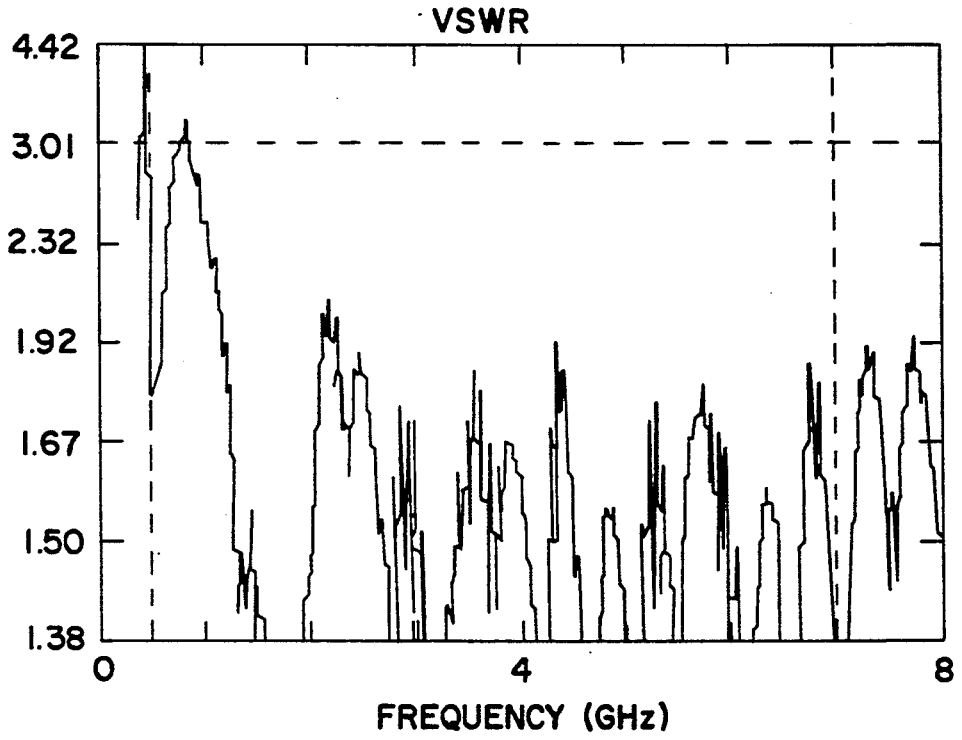
FIG. 12 is an actual plot of VSWR vs frequency for an antenna embodying this invention.
Figure 13:
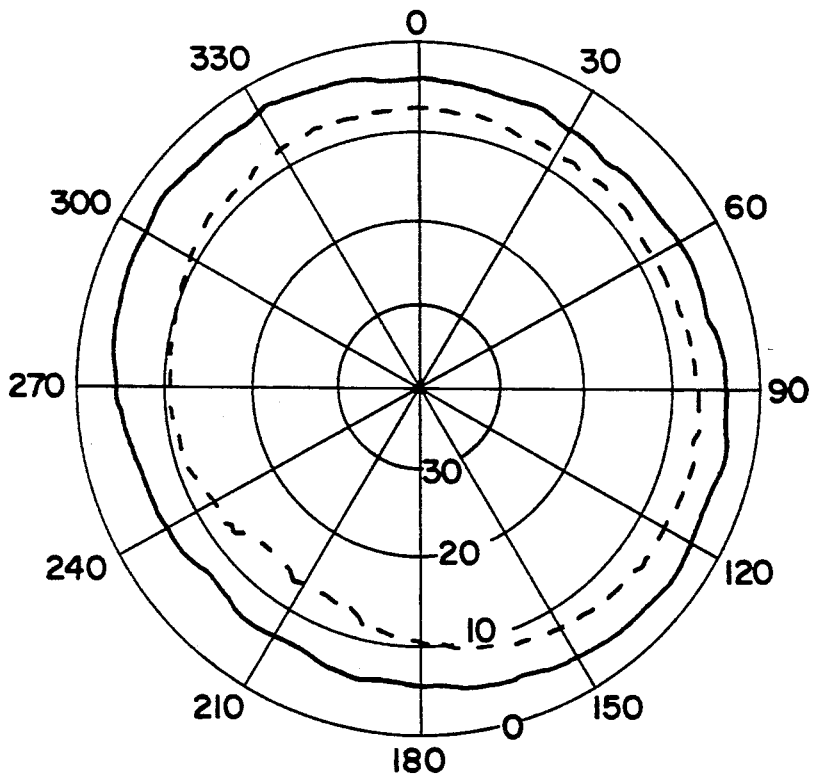
FIGS. 13 and 14 are plots of patterns of an antenna embodying this invention at two different frequencies demonstrating the performance of the antenna.
Figure 14:
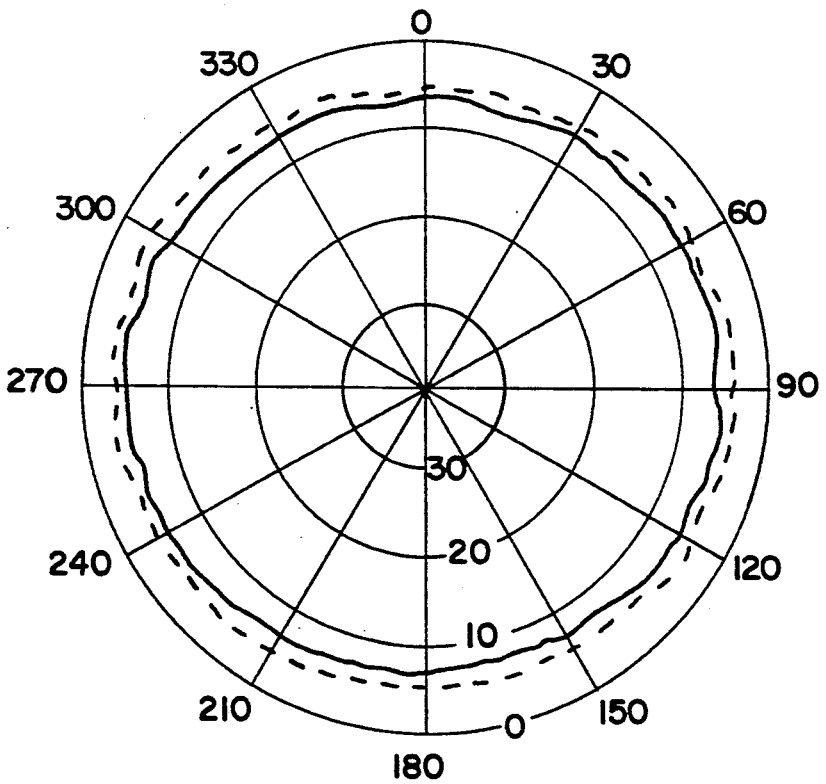

The VSWR of the prior art discone antenna shown in FIG. 1 when tested was 19.6:1. at 500 MHz. The rolled edge discone antenna embodying this invention and with a 5-layer polarizer has a greatly improved VSWR of slightly over 3.01 at 500 MHz as shown in FIG. 12 and operated almost entirely under 3.01:1 from 500 Mhz to 8 GHz. Significantly, an antenna embodying this invention that was constructed and and successfully operated had an outside diameter of 10.97" and a height of 11.23". In addition measured patterns of this antenna show that the antenna radiates both vertical and horizontal polarizations from −30 to +60 degrees elevation with good omnidirectional characteristics. Actual plots of measured patterns of an antenna embodying this invention are shown in FIGS. 13 and 14 (the solid lines indicating vertical polarization and the broken lines horizontal polarization) under the following conditions:

| | FIG. 13 | FIG. 14 |
|---|---|---|
| Frequency | 500 MHz | 7.0 GHz |
| Gain at 0° Vertical | −4.12 dBi | −1.5 dBi |
| Gain at 0° Horizontal | −7.58 dBi | −.61 dBi |

While the invention has been described with reference to its preferred embodiment, It will be understood by those skilled in the art that various changes may be made and equivalents may be substituted for the elements and steps thereof without departing from the true spirit and scope of the invention. In addition, modifications may be made to adapt a particular situation or material to the teaching of the invention without departing from its essential teaching.

We claim:

1. A discone antenna having a primary axis and first and second axially spaced coaxial elements defining therebetween an aperture:

said first element having an aperture-defining surface extending outwardly from said axis and being spaced progressively farther from said second element as radial spacing from said axis increases;

said second element having a plane surface perpendicular to said axis and spaced close to said first element at said axis;

each of said elements having an outer portion remote from said axis, each of said outer portions having a compound curved surface with a circular cross-section and extending away from the aperture and comprising the exterior surface of a donut-shaped structure defining part of a mouth of said aperture;

each of said elements being formed from a dielectric substance and having a metallic layer on the exterior surfaces thereof; and said elements being figures of revolution about said axis.

* * * * *